US012649962B2

(12) United States Patent
Bian et al.

(10) Patent No.: US 12,649,962 B2
(45) Date of Patent: Jun. 9, 2026

(54) MAGNESIUM ALLOY, MAGNESIUM ALLOY PLATE, MAGNESIUM ALLOY BAR, MANUFACTURING METHODS THEREOF, AND MAGNESIUM ALLOY MEMBER

(71) Applicant: NATIONAL INSTITUTE OF ADVANCED INDUSTRIAL SCIENCE AND TECHNOLOGY, Tokyo (JP)

(72) Inventors: Mingzhe Bian, Nagoya (JP); Xinsheng Huang, Nagoya (JP); Yasumasa Chino, Nagoya (JP); Isao Nakatsugawa, Nagoya (JP)

(73) Assignee: NATIONAL INSTITUTE OF ADVANCED INDUSTRIAL SCIENCE AND TECHNOLOGY, Tokyo (JP)

( * ) Notice: Subject to any disclaimer, the term of this patent is extended or adjusted under 35 U.S.C. 154(b) by 656 days.

(21) Appl. No.: 17/919,597

(22) PCT Filed: Apr. 6, 2021

(86) PCT No.: PCT/JP2021/014666
§ 371 (c)(1),
(2) Date: Oct. 18, 2022

(87) PCT Pub. No.: WO2021/215241
PCT Pub. Date: Oct. 28, 2021

(65) Prior Publication Data

US 2023/0183843 A1 Jun. 15, 2023

(30) Foreign Application Priority Data

Apr. 21, 2020 (JP) ..... 2020-075667

(51) Int. Cl.
*C22C 23/00* (2006.01)
*C22C 23/02* (2006.01)
*C22F 1/06* (2006.01)

(52) U.S. Cl.
CPC ..... *C22C 23/00* (2013.01); *C22C 23/02* (2013.01); *C22F 1/06* (2013.01)

(58) Field of Classification Search
None
See application file for complete search history.

(56) References Cited

U.S. PATENT DOCUMENTS

2020/0370156 A1* 11/2020 Zhou ..... C22F 1/06

FOREIGN PATENT DOCUMENTS

CN 108085548 A * 5/2018
CN 109439989 A * 3/2019 ..... C22C 1/03
(Continued)

OTHER PUBLICATIONS

English language machine translation of CN-109439989-A. Generated Apr. 30, 2025. (Year: 2025).*
(Continued)

*Primary Examiner* — Humera N. Sheikh
(74) *Attorney, Agent, or Firm* — Wenderoth, Lind & Ponack, L.L.P.

(57) ABSTRACT

Provided is a magnesium alloy in which Cu content is 0 to 1.5% by mass, Ni content is 0 to 0.5% by mass, Ca content is 0.05 to 1.0% by mass, Al content is 0 to 0.5% by mass, Zn content is 0 to 0.3% by mass, Mn content is 0 to 0.3% by mass, Zr content is 0 to 0.3% by mass, the total of the Cu content and the Ni content being 0.005% by mass to 2.0% by mass, and the balance being magnesium and unavoidable impurities.

8 Claims, 4 Drawing Sheets

(56) References Cited

FOREIGN PATENT DOCUMENTS

| | | | | |
|---|---|---|---|---|
| EP | 2 088 217 | | 8/2009 | |
| EP | 2088217 | A1 * | 8/2009 | ..... B22D 21/007 |
| JP | 2011-219820 | | 11/2011 | |
| JP | 5146767 | | 2/2013 | |
| WO | 2008/072435 | | 6/2008 | |
| WO | WO-2018021360 | A1 * | 2/2018 | ..... C22C 23/00 |

OTHER PUBLICATIONS

English language machine translation of CN-108085548-A. Generated Apr. 30, 2025. (Year: 2025).*
English language machine translation of WO-2018021360-A1. Generated Apr. 30, 2025. (Year: 2025).*
English Translation of Office Action issued Oct. 27, 2023, in Japanese Patent Application No. 2022-516942.
English Translation of Office Action issued Apr. 15, 2023, in Chinese Patent Application No. 202180029028.6.
English Translation of Office Action issued Sep. 20, 2024, in Korean Patent Application No. 10-2022-7036337.
Extended European Search Report issued Mar. 19, 2024, in European Patent Application No. 21792999.1.
Office Action issued Oct. 24, 2024, in European Patent Application No. 21 792 999.1.
International Search Report (ISR) issued Jul. 13, 2021 in International (PCT) Application No. PCT/JP2021/014666.

* cited by examiner

MAGNESIUM ALLOY, MAGNESIUM ALLOY PLATE, MAGNESIUM ALLOY BAR, MANUFACTURING METHODS THEREOF, AND MAGNESIUM ALLOY MEMBER

TECHNICAL FIELD

The present invention relates to a magnesium alloy having an excellent room-temperature formability and a high thermal conductivity, a magnesium alloy plate, a magnesium alloy bar, manufacturing methods thereof, and a magnesium alloy member.

BACKGROUND ART

Magnesium alloys are expected to be used as lightweight materials in the fields of aircrafts, automobiles, and electronic devices because of their smallest specific gravities among practical metals. However, it is known that magnesium alloys have a crystal structure of hexagonal close-packed structure, in which the number of slip systems is small near at room temperature, and hence its room-temperature formability is poor. This is due to that (0001) planes of hexagonal close-packed structure are arranged in parallel with the deformation direction in the crystallographic texture of the matrix (Mg phase) of the magnesium alloy plate. The formability is expected to be enhanced by randomizing the orientation of these (0001) planes as much as possible.

Patent Document 1 states a technique in which shear deformation is applied at room temperature with a roller leveler, followed by multiple recrystallization heat treatments to randomize the orientation of the (0001) planes in the matrix (Mg phase). Patent Document 2 states a technique in which the alloy is rolled near at solidus line followed by multiple recrystallization heat treatments to randomize the orientation of the (0001) planes. Furthermore, Patent Document 3 states a technique of adding a small amount of a specific element such as a rare earth element or calcium to Mg—Zn-based alloys thereby randomizing the orientation of the (0001) planes.

CITATION LIST

Patent Literature

Patent Literature 1: JP 2005-298885 A
Patent Literature 2: JP 2010-133005 A
Patent Literature 3: JP 2010-13725 A

Non Patent Literature

Non Patent Literature 1: Aluminum Handbook (4th edition), edited by Japan Light Metals Association Standardization General Committee, Japan Light Metals Association (1990), p. 25

Non Patent Literature 2: Magnesium Engineering Handbook, The Japan Magnesium Association, Magnesium Engineering Handbook Editorial Committee, Kallos Publishing Co. Ltd. (2000), p. 58

Non Patent Literature 3: G. Y. Oh, Y. G. Jung, W. Yang, S. K. Kim, H. K. Lim, Y. J. Kim: Mater. Trans. Vol. 56 (2015), pp. 1887-1892.

Non Patent Literature 4: Z. H. Li, T. T. Sasaki, T. Shiroyama, A. Miura, K. Uchida, K. Hono: Materials Research Letters Vol. 8 (2020), pp. 335-340.

SUMMARY OF INVENTION

Technical Problem

Although the room-temperature formability of magnesium alloys was improved by the methods of Patent Documents 1 to 3, status quo, the magnesium alloys have yet to be put into practical applications as magnesium alloy plates, or magnesium alloy bars. A factor of hindering the practical applications of the magnesium alloys by the methods of Patent Documents 1 to 3 is that they are poor in various functional properties (e.g., thermal conductivity) compared to those of aluminum alloy plates and aluminum alloy bars which are in a competitive relationship with magnesium alloy plates or magnesium alloy bars.

For example, focusing on thermal conductivity, aluminum alloy plates and bars used for structural applications have their thermal conductivities at room temperature (25° C.) of: 150 (W/(m·K)) as type 2000 alloys (2024 alloy-T6); 160 (W/(m·K)) as type 3000 alloys (average by all qualities in 3004 alloys); 120 (W/(m·K)) as type 5000 alloys (average by all qualities in 5083 alloys); 170 (W/(m·K)) as type 6000 alloys (6061 alloy-T6); and 130 (W/(m·K)) as type 7000 alloys (7075-T6) (Non Patent Literature 1).

In contrast, general-purpose magnesium alloy plates or magnesium alloy bars (AZ31 alloy: Mg-3Al-1Zn (all in wt. %)) have a thermal conductivity at room temperature (20° C.) of 75 (W/(m·K)) (Non Patent Literature 2), the problem is that they are difficult to be used in applications such as electronic component housings in transport devices, or a casing for small information devices such as notebook PCs or smartphones, which require a high level of heat dissipation properties.

In addition, in the matrix (Mg) phase of AZ31 alloy, the (0001) planes of close-packed hexagonal crystal present parallel to the surface of a deformed material, in which the (0001) plane texture intensity is extremely high, and slip deformation can take place only along the (0001) plane at room temperature, as a result typical AZ31 alloy plates and bars are difficult to be deformed at room temperature.

Under such circumstances, strenuous research activities have been made to improve the thermal conductivity of magnesium alloys at room temperature, and a Mg—Zn—Ca-based alloy system has received attention as an alloy having excellent thermal conductivity (110 to 120 (W/(m K))) at room temperature (25 to 30° C.) (Non Patent Literatures 3 and 4). While the Mg—Zn—Ca-based alloy has a thermal conductivity (110 to 120 (W/(m·K))) approximately 50% higher than those of general-purpose magnesium alloys, the thermal conductivity is yet lower in comparison with the thermal conductivities (120 to 170 (W/(m·K))) of aluminum alloys for load-bearing component applications at room temperature (25° C.). The development of magnesium alloys (alloy plates or alloy bars) having higher thermal conductivity is desirable so as the magnesium alloy members to be used as a member requiring high heat dissipation property.

The present invention has been made in view of the circumstances described above, and an object of the present invention is to provide a magnesium alloy which is readily deformed at room temperature and has high thermal conductivity (heat dissipation properties), a magnesium alloy plate, a magnesium alloy bar, methods of producing these, and a magnesium alloy member.

Solution to Problem

In order to solve the above problems, a magnesium alloy of the present invention includes:

Cu in a content of 0 to 1.5% by mass,
Ni in a content of 0 to 0.5% by mass,
Ca in a content of 0.05 to 1.0% by mass,
Al in a content of 0 to 0.5% by mass,
Zn in a content of 0 to 0.3% by mass,
Mn in a content of 0 to 0.3% by mass, and
Zr in a content of 0 to 0.3% by mass,
wherein a total amount of the Cu and the Ni is 0.005 to 2.0% by mass, and the balance is magnesium and unavoidable impurities.

The magnesium alloy plate of the present invention is a magnesium alloy plate containing the above-described magnesium alloy of the present invention, and is characterized in that the texture intensity of (0001) plane of the hexagonal close-packed crystal is 3.8 or less in the matrix (Mg phase).

The magnesium alloy bar of the present invention is a magnesium alloy bar containing the magnesium alloy of the present invention, and is characterized in that the texture intensity of (0001) plane of hexagonal close-packed crystal is 6.8 or less in the matrix (Mg phase).

The method of producing a magnesium alloy of the present invention is characterized in that the method includes a casting step of preparing the magnesium alloy.

The method of producing a magnesium alloy plate of the present invention is characterized in that the method includes:

a casting step of preparing a magnesium alloy billet made of the magnesium
alloy; and
a rolling step in which the magnesium alloy billet or a workpiece thereof is rolled at 200° C. to 500° C.

The method of producing a magnesium alloy bar of the present invention is characterized in that the method includes:

a casting step of preparing a magnesium alloy billet made of the magnesium alloy; and
an extrusion step in which the magnesium alloy or a workpiece thereof is extruded at 200° C. to 500° C.

The magnesium alloy member of the present invention is characterized in that the member contains the above-described magnesium alloy.

Advantageous Effects of Invention

The magnesium alloy, the magnesium alloy plate, and the magnesium alloy bar of the present invention are readily deformed at room temperature and have excellent thermal conductivity (heat dissipation properties). Therefore, they exhibit an excellent heat dissipation and room-temperature formability, for example, when they are used as a member of electronic component housings for transport devices (PCU case and the like), or casings for information devices such as smartphones or notebook PCs, which require high heat dissipation properties. The production method of the present invention can reliably provide a magnesium alloy, a magnesium alloy plate, and a magnesium alloy bar which are readily deformed at room temperature and have excellent heat dissipation properties.

DESCRIPTION OF EMBODIMENTS

Figure 1:
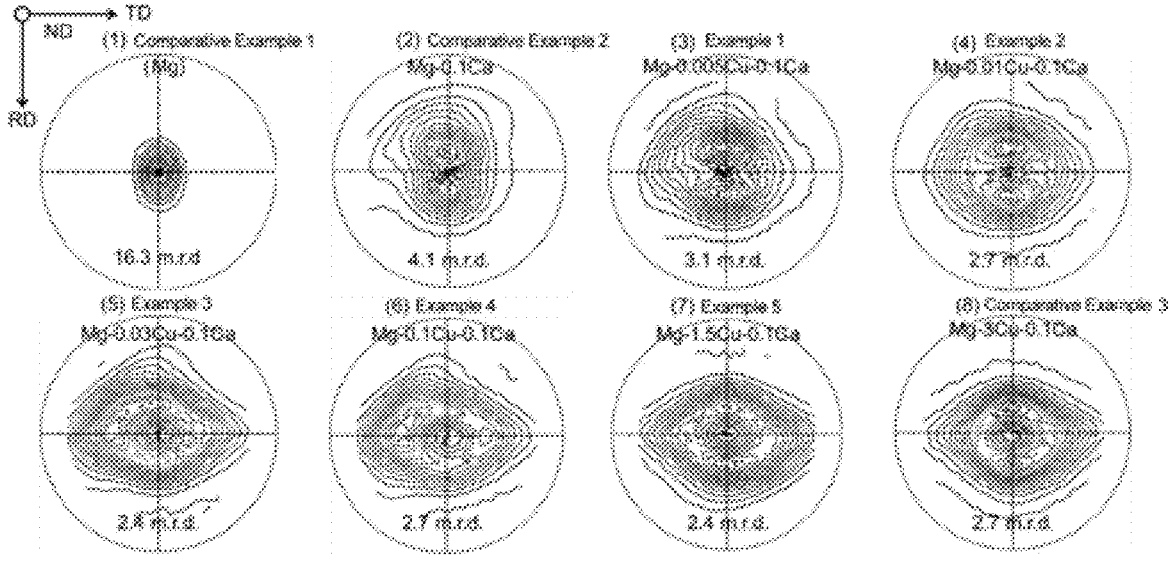
FIG. 1 shows the results of texture analysis of (0001) plane in matrices (Mg phase) of Example 1 to 5 and Comparative Example 1 to 3 by means of X-ray diffraction.

It is known that pure magnesium has a thermal conductivity of 167 (W/(m·K)) at room temperature (20° C.), which is substantially equivalent to that of aluminum alloys for structure (Non Patent Literature 2). However, the thermal conductivity of the magnesium alloy tends to decrease with addition of an element having a solid solubility in magnesium, and the thermal conductivity noticeably decreases with the addition of Al, which tends to most solid-soluble in magnesium. For instance, the thermal conductivity of AZ31 alloy (Mg-3Al-1Zn (all in wt. %)) at room temperature (20° C.) decreases to 75 (W/(m·K)) (Non Patent Literature 2). In comparison with Al, Zn and Ca are less solid-soluble in magnesium, and hence Mg—Zn—Ca-based alloys exhibit a thermal conductivity (110 to 120 (W/(m·K))) higher than that of the AZ31 alloy at room temperature (25 to 30° C.) (Non Patent Literature 3, Non Patent Literature 4).

As described above, the addition of a trace amount of Ca to the Mg—Zn-based alloy can randomize the orientation of the (0001) plane in the matrix (Mg phase), thereby enabling to dramatically improve the room-temperature formability of the magnesium alloy. On the other hand, Al, Zn, and Ca each have a solid solubility of up to 13% at 437° C., up to 6.2% at 340° C., and up to 1.34% at 516.5° C. in magnesium, respectively (Magnesium Technical Handbook, Magnesium Society of Japan, Magnesium Technical Handbook Editorial Committee, Kallos Publishing Co. Ltd. (2000), pp. 78-78). Therefore, it is envisaged that if the addition of an element having less solid solubility in magnesium than Al, Zn or Ca can weaken the texture intensity of the (0001) plane in the matrix (Mg phase) of the magnesium alloy plate and the magnesium alloy bar, then there can be developed a magnesium alloy having both high level of room-temperature formability and high thermal conductivity, and a magnesium alloy plate and a magnesium alloy bar made therefrom.

The present inventors have made a systematic search for an element group including elements having less solid solubility in magnesium than Zn or Ca, and enabling to randomize the orientation of the (0001) plane in the matrix (Mg phase), and as a result, have focused on Cu and Ca having a maximum solid solubility of 0.035% in magnesium (at 485° C.) (Magnesium Technical Handbook, Magnesium Society of Japan, Magnesium Technical Handbook Editorial Committee, Kallos Publishing Co. Ltd. (2000), pp. 78-78). For Mg—Cu—Ca-based alloy having Cu and Ca added, the present inventors have examined an optimum alloy addition concentration and have selected specific rolling conditions and extrusion conditions thereby having found that the texture during recrystallization can act to weaken the texture intensity of (0001) plane and to provide a high thermal conductivity concurrently, and have completed the present invention.

Furthermore, with respect to another alloy system, the present inventors have focused on Ni and Ca the maximum solid solubility of each of which in magnesium is smaller than that of Cu (Magnesium Technical Handbook, Magnesium Society of Japan, Magnesium Technical Handbook Editorial Committee, Kallos Publishing Co. Ltd. (2000), pp.

84-84), and found that Mg—Ni—Ca-based alloy also can be provided with properties similar to those of a Mg—Cu—Ca-based alloy, and have completed the present invention.

Hereinafter, one embodiment of the magnesium alloy of the present invention, and a magnesium alloy plate and a magnesium alloy bar made from the same will be described.

(Components of Magnesium Alloy)

The magnesium alloy of the present invention includes:

Cu in a content of 0 to 1.5% by mass;

Ni in a content of 0 to 0.5% by mass;

Ca in a content of 0.05 to 1.0% by mass;

Al in a content of 0 to 0.5% by mass;

Zn in a content of 0 to 0.3% by mass;

Mn in a content of 0 to 0.3% by mass; and

Zr in a content of 0 to 0.3% by mass, and the total amount of Cu and Ni is 0.005 to 2.0% by mass, and the balance is magnesium and unavoidable impurities.

In the magnesium alloy of the present invention, the Cu content is 0 to 1.5% by mass. In the Mg—Cu—Ca alloy, the Cu content is preferably 0.005 to 1.5% by mass, more preferably 0.03% by mass to 1.0% by mass, and still more preferably 0.03% by mass to 0.3% by mass. When the Cu content is within this range, an adequate amount of Cu dissolves in magnesium (matrix), which leads to the segregation of Cu at grain boundaries, whereby the orientation of the (0001) plane can be effectively randomized. In contrast, when the Cu content exceeds 1.5% by mass, an unacceptable amount of $Mg_2Cu$ precipitates is generated, whereby high formability cannot be achieved. When the Cu content is less than 0.005% by mass, the texture intensity of the (0001) plane in the matrix (Mg phase) cannot be sufficiently weakened.

Note that Mg and Cu have corrosion potentials of −1.65 V and −0.12 V, respectively, (based on saturated calomel (SCE) electrode), and there is a relatively large difference therebetween. Hence, when an excessive amount of Cu is mixed in Mg, the corrosion properties are remarkably deteriorated (G. Song and A. Atrens: Adv. Eng. Mater. Vol. 5 (2003) pp. 837-858). Therefore, in the magnesium alloy of the present invention, an addition of copper in an amount more than 1.5% by mass should be avoided also in terms of corrosion properties. In contrast, when the amount of Cu is chosen to be 0.1% or less and the amount of Ca is chosen to be 1% or less, the magnesium alloy of the present invention exhibits a high corrosion resistance (corrosion rate: 4 mg/cm2/day or less) equivalent to or higher than that of the general-purpose magnesium alloy (AZ31 alloy).

In the magnesium alloy of the present invention, the content of Ni is 0 to 0.5% by mass. In the Mg—Ni—Ca alloy, the Ni content is preferably 0.01 to 0.5% by mass, and more preferably 0.05% by mass to 0.3% by mass. When the Ni content is within this range, an adequate amount of Ni dissolves in magnesium (matrix), which leads to the segregation of Ni at grain boundaries, thereby enabling to effectively randomize the orientation of the (0001) plane. In contrast, when the Ni content exceeds 0.5% by mass, an unacceptable amount of $Mg_2Ni$ precipitates is generated, and high formability cannot be achieved. When the Ni content is less than 0.01% by mass, it is difficult to sufficiently weaken the texture intensity of the (0001) plane in the matrix (Mg phase).

Note that Mg and Ni have corrosion potentials of −1.65 V and +0.01 V, respectively, (based on saturated calomel (SCE) electrode), and there is a relatively large difference therebetween as in the case of Mg and Cu. Hence, when an excessive amount of Ni is mixed in Mg, the corrosion properties thereof are remarkably deteriorated (G. Song and A. Atrens: Adv. Eng. Mater. Vol. 5 (2003) pp. 837-858). Therefore, also in the magnesium alloy of the present invention, addition of more than 0.5% by mass of Ni should be avoided also in terms of corrosion properties. Specifically, for example, when the concentration of Ni is chosen to be about 0.01% and the concentration of Ca is chosen to be about 0.1%, the magnesium alloy of the present invention exhibits a high corrosion resistance (corrosion rate: 4 $mg/cm^2$/day or less) equivalent to or higher than that of the general-purpose magnesium alloy (AZ31 alloy).

Note that, in the Mg—Ni—Ca alloy, the amount of Ca added is preferably 0.05% to 0.5%.

In the magnesium alloy of the present invention, the total amount of Cu and Ni is 0.005% by mass to 2.0% by mass, and more preferably 0.01 to 1.0% by mass.

In the magnesium alloy of the present invention, there is no detrimental effect attributed to the coexistence of Cu and Ni.

In the magnesium alloy of the present invention, the Ca content is 0.05 to 1.0% by mass. The Ca content is preferably 0.1 to 0.5% by mass. When the Ca content is within this range, an adequate amount of Ca dissolves in Mg (matrix), which leads to the segregation of Ca at grain boundaries, thereby enabling to effectively randomize the orientation of the (0001) plane. In contrast, when the Ca content exceeds 1.0% by mass, an unacceptable amount of $Mg_2Ca$ precipitates is generated, and high formability cannot be achieved. When the Ca content is less than 0.05% by mass, the texture intensity of the (0001) plane in the matrix (Mg phase) cannot be sufficiently weakened.

The magnesium alloy of the present invention can contain 0 to 0.5% by mass of Al in view of facilitating casting in the production of an ingot. When Al is contained at an amount exceeding 0.5% by mass, thermal conductivity and ductility decrease, and hence the Al content is 0.5% or less.

Furthermore, the magnesium alloy of the present invention may contain 0 to 0.3% by mass of Zn, Mn, and Zr each, in addition to the above-described alloy components. The purpose of adding Zn and Zr is to increase the strength of the material by solid solution strengthening or precipitation strengthening, and the purpose of adding Mn is to form a compound with a trace amount of iron as an impurity thereby increasing corrosion resistance. When the content of each element is 0.3% by mass or less, the thermal conductivity is not so much reduced.

The balance other than the components described above is magnesium and unavoidable impurities. Examples of the inevitable impurities can include Fe and C.

Among the magnesium alloys of the present invention, for example, with respect to an alloy contains an alloy in which the content of Cu is 0.03 to 0.3% by mass, the content of Ca is 0.1 to 0.5% by mass, the content of Al is 0.1 to 0.5% by mass, the content of Mn is 0 to 0.3% by mass, and the balance is magnesium and unavoidable impurities, a magnesium alloy plate or a magnesium alloy bar is prepared therefrom, and then annealed at 200° C. to 500° C., followed by a heat treatment at 150 to 250° C., whereby the hardness and the yield stress of the material can be increased with aging precipitation. This is because of that a fine intermetallic compound including Al and Ca is precipitated during the heat treatment.

(Properties of Magnesium Alloy Plate and Magnesium Alloy Bar)

The magnesium alloy of the present invention described above can be used to produce a magnesium alloy plate and a magnesium alloy bar. A method of producing the magnesium alloy plate and the magnesium alloy bar will be described later.

In the magnesium alloy plate of the present invention, the texture intensity of the (0001) plane of hexagonal close-packed crystal is 3.8 or less in the matrix (Mg phase). In the magnesium alloy bar, the texture intensity of the (0001) plane of hexagonal close-packed crystal is 6.8 or less in the matrix (Mg phase). Since the orientation of the (0001) plane is controlled, the magnesium alloy plate and the bar have excellent room-temperature formability. As set forth in the section of Examples, the texture intensity of the (0001) plane can be measured by an XRD method (Schultz reflection method), and it refers to a value obtained by normalizing the measurement data with random data (internal standard data and the like).

The magnesium alloy plate and the magnesium alloy bar of the present invention are readily deformed by press forming at room temperature.

The magnesium alloy plate exhibits a formability equivalent to that of an aluminum alloy (6.5 or more in the Erichsen value), or a formability comparable to that of an aluminum alloy (7.5 or more in the Erichsen value). The Erichsen cupping test is a test in accordance with JIS B 7729:1995 and JIS Z 2247:1998.

The magnesium alloy bar exhibits a formability equivalent to that of an aluminum alloy (percentage elongation after fracture of 15% or more in a room temperature tensile test), or formability comparable to that of an aluminum alloy (percentage elongation after fracture of 20% in a room temperature tensile test). The tensile test is a test in accordance with JIS Z 2241:2011.

The magnesium alloy plate and the magnesium alloy bar of the present invention, except for some alloys, exhibit corrosion rates equal to or higher than those of general-purpose magnesium alloys (AZ31 alloy: 2 to 5 ($mg/cm^2$/day)) in a saltwater immersion test. The saltwater immersion test is a test in accordance with JIS H 0541:2003.

With respect to some compositions of the magnesium alloy plate and the magnesium bar of the present invention, they exhibit an aging hardening property.

Specifically, after subjected to a predetermined heat treatment, they exhibit a property in which an increase in hardness is confirmed by Vickers hardness according to JIS Z 2244.

The magnesium alloy plate and the magnesium alloy bar of the present invention have a thermal conductivity (120 (W/(m·K)) or more) at room temperature (10 to 35° C.) comparable to that of aluminum alloys for load-bearing applications.

The measurement values of the thermal conductivity (λ: W/(m·K)) of the magnesium alloy plate and the magnesium alloy bar at room temperature are defined as values obtained by substituting measured values of thermal diffusivity (α: $m^2/s$), the specific heat (Cp: J/(kg·K)), and the density (ρ: $kg/m^3$) into the following Formula (1).

$$\lambda=\alpha\cdot Cp\cdot\rho \quad (1)$$

Note that, the thermal diffusivity (a) refers to a value which is obtained in such a way that a sample having a diameter of 10.0 mm and a thickness of 1.5 to 2.5 mm is cut out from a magnesium alloy plate or a magnesium alloy bar and the sample is measured by laser flash method (measurement temperature of 10 to 35° C. in vacuo), the specific heat (Cp) refers to a value measured by DSC method (Ar gas flow (20 mL/min), temperature raising rate of 10° C./min, measurement temperature of 10 to 35° C.), and the density (p) refers to a value measured by a dimension measurement method (measurement temperature: 10 to 35° C.).

Note that the stated measurement of the thermal conductivity is in accordance with JIS R 1611:2010. With regard to the measurement temperatures, when it is within a range of 10 to 35° C., no significant variations are observed in the thermal conductivity. For more precise measurement, the measurement is preferably performed at a temperature within a range of 25° C.±2° C.

In the calculation of the thermal conductivity, the thermal diffusivity, the specific heat, and the density each need to be determined individually as described above, and it may take a lot of time to derive the measurement value. Note that, there is known a tendency in which the thermal conductivity (λ) and the electrical conductivity (σ) of a metal are in a proportional relationship at the same temperature (Wiedemann-Franz law), and it has been reported that magnesium also approximately follows this relationship (Magnesium Technical Handbook, Magnesium Society of Japan, Magnesium Technical Handbook Editorial Committee, Kallos Publishing Co. Ltd. (2000), p. 63). Therefore, the electrical conductivity can also be used as an index for grasping the magnitude of the thermal conductivity.

The electrical conductivity of the magnesium alloy plate and the magnesium alloy bar of the present invention exhibits a value of $1.3\times10^7$ (S/m) or more at room temperature (10 to 35° C.). Therefore, the indication of an electrical conductivity of $1.3\times10^7$ (S/m) or more can also be used as an index for a material having an excellent thermal conductivity.

The electrical conductivity (a) shown in Examples described later refers to a value measured by a four-terminal (probe) method at room temperature (10 to 35° C.). The method of measuring the electrical conductivity is in accordance with JIS K 7194:1994. With regard to the measurement temperature, when it is within the range of 10 to 35° C., no significant variations are observed in the electrical conductivity. For more precise measurement, the measurement is preferably performed at a temperature within a range of 25° C.±2° C.

The magnesium alloy plate and the magnesium alloy bar of the present invention have an excellent room-temperature formability and an excellent thermal conductivity, so that there can be achieved a balance between the formability needed for manufacturing an electronic component housing in automobiles or an information device housing and the high thermal conductivity required as heat dissipation properties.

The magnesium alloy member of the present invention is produced from the magnesium alloy plate or the magnesium alloy bar of the present invention described above. The shape of the magnesium alloy member is not particularly limited, and examples thereof include a housing of an electronic component an automobile, and a casing of an information device.

Next, there will be described an embodiment of a method of producing the magnesium alloy plate and the magnesium alloy bar of the present invention. (Manufacturing methods of magnesium alloy, of magnesium alloy plate, and of magnesium alloy bar)

The manufacturing method of the magnesium alloy (of magnesium alloy plate, or of magnesium alloy bar) of the present invention includes a casting step of preparing a billet made of the magnesium alloy of the present invention described above.

Specifically, the method includes a casting step of preparing a magnesium alloy (magnesium alloy billet), wherein the magnesium alloy (magnesium alloy billet) contains Cu in a content of 0 to 1.5% by mass, or 0.005 to 1.5% by mass;

Ni in a content of 0 to 0.5% by mass, or 0.01 to 0.5% by mass;

Ca in a content of 0.05 to 1.0% by mass;

Al in a content of 0 to 0.5% by mass;

Zn in a content of 0 to 0.3% by mass;

Mn in a content of 0 to 0.3% by mass; and

Zr in a content of 0 to 0.3% by mass, the total amount of Cu and Ni being 0.005 to 2.0% by mass, and the balance being magnesium and unavoidable impurities. In the casting step, traditionally known methods and conditions can be appropriately used, and there is no particular limitations on the shape and the like of the magnesium alloy.

Next, in the case of preparing a magnesium alloy plate, there is included a rolling step in which a magnesium alloy billet made of a magnesium alloy or a workpiece thereof is rolled at 200° C. to 500° C.

Specifically, warm extrusion and/or rough rolling are performed to produce a rolling material having a sheet thickness of, for example, about 4 mm to 10 mm. Thereafter, warm rolling (about 200° C. to 350° C.) or hot rolling (350° C. to 500° C.) can be performed to have a desired sheet thickness. Typically, the rolling material can be rolled to give a thickness from about 0.5 mm to about 2.0 mm, which is a plate thickness used in electronic devices, automobiles, and the like.

Then, after the rolling step, the rolled material can be annealed at 200° C. to 500° C. (annealing (recrystallization heat treatment) step). The duration for the annealing step can be appropriately chosen, and for example, about 30 minutes to 6 hours can be exemplified. In the case where the recrystallization of the material has progressed, the annealing step can be omitted.

In the preparation of a magnesium alloy bar, after the casting step, there is included an extrusion step in which the magnesium alloy billet or a workpiece thereof is extruded at 200° C. to 500° C. Specifically, the billet and the mold are heated to 200° C. to 500° C. in advance, followed by extrusion to prepare a bar material.

Then, after the extrusion step, the extruded material can be annealed at 200° C. to 500° C. as necessary (annealing (recrystallization heat treatment) step). The duration for the annealing step can be appropriately chosen, and for example, about 30 minutes to 24 hours can be exemplified. In the case where the recrystallization of the material has progressed during the extrusion step, the annealing step can be omitted.

For example, a magnesium alloy plate material and a magnesium alloy bar, which are prepared by using a magnesium alloy billet, in which the Cu content is 0.03 to 0.3% by mass, the Ca content is 0.1 to 0.5% by mass, the Al content is 0.1 to 0.5% by mass, the Mn content is 0 to 0.3% by mass, and the balance is magnesium and unavoidable impurities, can be heat-treated at 150 to 250° C. to improve the hardness and yield stress of the material by aging precipitation hardening (aging treatment step). With respect to the duration for the heat treatment in the aging treatment step, there can be exemplified for example, 0.5 to 100 hours. Since the major determinant of the performance of the aging precipitation hardening is the alloy composition, the alloy composition is set to a predetermined alloy composition, whereby the similar effect exhibits in either of the magnesium alloy plate material and the magnesium alloy bar.

Note that, the method of producing the magnesium alloy plate and the magnesium alloy bar of the present invention may include, for example, known plastic deformation processing such as extrusion processing, forging processing, and drawing processing, besides the above-described steps.

Furthermore, for example, the magnesium alloy bar of the present invention may have a tubular shape with a hollow inside. Furthermore, for example, the magnesium alloy plate and the magnesium alloy bar of the present invention are not restricted to have any particular thickness, and may be in the form of a foil material, a wire material, a strip material, or the like.

The magnesium alloy, the magnesium alloy plate, the magnesium alloy bar, the manufacturing methods thereof, and the magnesium alloy member of the present invention are not limited to the embodiments set forth above.

EXAMPLES

The magnesium alloy, the magnesium alloy plate, the magnesium alloy bar, the manufacturing methods thereof, and the like of the present invention will be described in more detail with reference to Examples, but the present invention is not limited to the following Examples in any way.

<1> Preparation of Magnesium Alloy Plate and Magnesium Alloy Bar

A magnesium alloy billet having the chemical components shown in Table 1 was prepared by a melt casting method (casting step). The alloy was melted at a predetermined temperature (set forth in Table 1 as Casting temperature) under an argon atmosphere in a high-frequency induction melting furnace. Thereafter, the molten alloy was cast into a mold having a thickness of 30 mm or a mold having a diameter of 40 mm to prepare a magnesium alloy billet (ingot) for extrusion processing. Next, with respect to the sheet material, the magnesium alloy billet (ingot) having a thickness of 30 mm was extruded at a predetermined temperature (set forth in Table 1 as Extruding temperature) to form a sheet having a sheet thickness of 5 mm, followed by rolling at a sample temperature of 350° C. to give a magnesium alloy plate having a sheet thickness of 1.0 mm (rolling step). Some magnesium alloy plates were homogenized at a predetermined temperature for a predetermined time followed by rolling (set forth in Table 1 as Homogenization treatment condition prior to rolling). These magnesium alloy plates were annealed at 300° C. for 2 hours (recrystallization heat treatment) after rolling according to a conventional production process (annealing step). Some magnesium alloy plates were annealed at 170° C. for 8 hours (aging treatment step).

With respect to the magnesium alloy bar, the magnesium alloy billet (ingot) having a diameter of 40 mm was extruded at an extrusion ratio of 40 at a predetermined temperature (set forth in Table 1 as Extruding temperature) to prepare a bar material having a diameter of 6 mm (extrusion step). With respect to the annealing after the extrusion process (recrystallization heat treatment), there were prepared two kinds of samples: samples not subjected to this annealing; and samples subjected to this annealing at 450° C. for 24 hours (annealing step).

[Table 1]

TABLE 1

| | Alloy | Cu (wt. %) | Ca (wt. %) | Al (wt. %) | Mn (wt. %) | Zn (wt. %) | Zr (wt. %) | Ni (wt. %) | Casting temperature (° C.) | Extruding temperature (° C.) | Rolling temperature (° C.) | Homogenization treatment condition prior to rolling | Aging treatment condition |
|---|---|---|---|---|---|---|---|---|---|---|---|---|---|
| Example 1 | Mg-0.005Cu-0.1Ca | 0.005 | 0.1 | — | — | — | — | — | 820 | 400 | 350 | No | No |
| Example 2 | Mg-0.01Cu-0.1Ca | 0.01 | 0.1 | — | — | — | — | — | 820 | 400 | 350 | No | No |
| Example 3 | Mg-0.03Cu-0.1Ca | 0.03 | 0.1 | — | — | — | — | — | 820 | 400 | 350 | No | No |
| Example 4 | Mg-0.1Cu-0.1Ca | 0.1 | 0.1 | — | — | — | — | — | 820 | 400 | 350 | No | No |
| Example 5 | Mg-1.5Cu-0.1Ca | 1.5 | 0.1 | — | — | — | — | — | 820 | 400 | 350 | No | No |
| Example 6 | Mg-0.03Cu-0.05Ca | 0.03 | 0.05 | — | — | — | — | — | 820 | 400 | 350 | No | No |
| Example 7 | Mg-0.03Cu-0.5Ca | 0.03 | 0.5 | — | — | — | — | — | 820 | 400 | 350 | 450° C./24 h | No |
| Example 8 | Mg-0.03Cu-1Ca | 0.03 | 1 | — | — | — | — | — | 820 | 400 | 350 | 450° C./24 h | No |
| Example 9 | Mg-0.02Cu-0.05Ca | 0.02 | 0.05 | — | — | — | — | — | 820 | 400 | 350 | No | No |
| Example 10 | Mg-0.03Cu-0.1Ca-0.1Al | 0.03 | 0.1 | 0.1 | — | — | — | — | 820 | 400 | 400 | No | No |
| Example 11 | Mg-0.03Cu-0.1Ca-0.1Mn | 0.03 | 0.1 | — | 0.1 | — | — | — | 820 | 400 | 400 | No | No |
| Example 12 | Mg-0.03Cu-0.1Ca-0.1Al-0.1Mn | 0.03 | 0.1 | 0.1 | 0.1 | — | — | — | 820 | 400 | 400 | No | 170° C./8 h |
| Example 13 | Mg-0.03Cu-0.1Ca-0.3Al | 0.03 | 0.1 | 0.3 | — | — | — | — | 820 | 400 | 400 | No | No |
| Example 14 | Mg-0.03Cu-0.1Ca-0.3Mn | 0.03 | 0.1 | — | 0.3 | — | — | — | 820 | 400 | 400 | No | No |
| Example 15 | Mg-0.03Cu-0.5Ca-0.5Al-0.3Mn | 0.03 | 0.5 | 0.5 | 0.3 | — | — | — | 820 | 400 | 200 | No | 170° C./8 h |
| Example 16 | Mg-0.1Cu-0.5Ca-0.5Al-0.3Mn | 0.1 | 0.5 | 0.5 | 0.3 | — | — | — | 820 | 400 | 200 | No | 170° C./8 h |
| Example 17 | Mg-0.3Cu-0.5Ca-0.5Al-0.3Mn | 0.3 | 0.5 | 0.5 | 0.3 | — | — | — | 820 | 400 | 200 | No | 170° C./8 h |
| Example 18 | Mg-0.03Cu-0.1Ca-0.1Zn | 0.03 | 0.1 | — | — | 0.1 | — | — | 820 | 400 | 400 | No | No |
| Example 19 | Mg-0.03Cu-0.1Ca-0.1Zr | 0.03 | 0.1 | — | — | — | 0.1 | — | 820 | 400 | 400 | No | No |
| Example 20 | Mg-0.03Cu-0.1Ca-0.1Zn-0.1Zr | 0.03 | 0.1 | — | — | 0.1 | 0.1 | — | 820 | 400 | 400 | No | No |
| Example 21 | Mg-0.03Cu-0.1Ca-0.3Zn | 0.03 | 0.1 | — | — | 0.3 | — | — | 820 | 400 | 400 | No | No |
| Example 22 | Mg-0.03Cu-0.1Ca-0.3Zr | 0.03 | 0.1 | — | — | — | 0.3 | — | 820 | 400 | 400 | No | No |
| Example 23 | Mg-0.03Cu-0.1Ca-0.3Zn-0.3Zr | 0.03 | 0.1 | | | 0.3 | 0.3 | — | 820 | 400 | 400 | No | No |
| Example 24 | Mg-0.01Ni-0.1Ca | — | 0.1 | — | — | — | — | 0.01 | 820 | 400 | 400 | No | No |
| Example 25 | Mg-0.0238Ni-0.1Ca | — | 0.1 | — | — | — | — | 0.0238 | 820 | 400 | 400 | No | No |
| Example 26 | Mg-0.1Ni-0.1Ca | — | 0.1 | — | — | — | — | 0.1 | 820 | 400 | 400 | No | No |
| Example 27 | Mg-0.5Ni-0.1Ca | — | 0.1 | — | — | — | — | 0.5 | 820 | 400 | 400 | No | No |
| Example 28 | Mg-0.1Ni-0.05Ca | — | 0.05 | — | — | — | — | 0.1 | 820 | 400 | 400 | No | No |
| Example 29 | Mg-0.03Cu-0.05Ca | 0.03 | 0.05 | — | — | — | — | — | 820 | 350 | — | No | No |
| Example 30 | Mg-0.03Cu-0.1Ca | 0.03 | 0.1 | — | — | — | — | — | 820 | 350 | — | No | No |
| Example 31 | Mg-0.1Cu-0.1Ca | 0.1 | 0.1 | — | — | — | — | — | 820 | 350 | — | No | No |
| Example 32 | Mg-1.5Cu-0.1Ca | 1.5 | 0.1 | — | — | — | — | — | 820 | 350 | — | No | No |
| Example 33 | Mg-0.1Ni-0.1Ca | — | 0.1 | — | — | — | — | 0.1 | 820 | 350 | — | No | No |
| Comparative Example 1 | Mg | — | — | — | — | — | — | — | 740 | 400 | 350 | No | No |
| Comparative Example 2 | Mg-0.1Ca | — | 0.1 | — | — | — | — | — | 740 | 380 | 350 | No | No |
| Comparative Example 3 | Mg-3Cu-0.1Ca | 3 | 0.1 | — | — | — | — | — | 820 | 400 | 350 | No | No |
| Comparative Example 4 | Mg-0.03Cu | 0.03 | — | — | — | — | — | — | 820 | 400 | 350 | No | No |
| Comparative Example 5 | Mg-0.03Cu-0.01Ca | 0.03 | 0.01 | — | — | — | — | — | 820 | 400 | 350 | No | No |
| Comparative Example 6 | Mg-0.03Cu-0.03Ca | 0.03 | 0.03 | — | — | — | — | — | 820 | 400 | 350 | No | No |
| Comparative Example 7 | Mg-0.03Cu-2Ca | 0.03 | 2 | — | — | — | — | — | 820 | 400 | 350 | 450° C./24 h | No |
| Comparative Example 8 | Mg-0.1Ni | — | — | — | — | — | — | 0.1 | 820 | 400 | 400 | No | No |
| Comparative Example 9 | Mg-1.5Ni-0.1Ca | — | 0.1 | — | — | — | — | 1.5 | 820 | 400 | 400 | No | No |
| Comparative Example 10 | Mg-3Ni-0.1Ca | — | 0.1 | — | — | — | — | 3 | 820 | 400 | 400 | No | No |
| Comparative Example 11 | Mg-0.1Ni-0.01Ca | — | 0.01 | — | — | — | — | 0.1 | 820 | 400 | 400 | No | No |
| Comparative Example 12 | Mg-0.1Ni-2Ca | — | 2 | — | — | — | — | 0.1 | 820 | 400 | 400 | 450° C./24 h | No |
| Comparative Example 13 | AZ31 (Mg-3Al-1Zn in wt. %) | — | — | — | — | — | — | — | 740 | 400 | 350 | No | No |
| Comparative Example 14 | Mg-0.03Cu-2Ca | 0.03 | 2 | — | — | — | — | — | 820 | 350 | — | No | No |

<2> X-Ray Diffraction

The texture of (0001) plane in the matrix (Mg phase) of each of the magnesium alloy plates of Examples 1 to 28 and Comparative Examples 1 to 13 was measured by an XRD method (Schultz reflection method). In the measurement, a disk of φ33 mm×1 mm was cut out from the rolled material, and the RD-TD surface was grinded to a thickness of 0.5 mm, followed by surface polishing with #4000 SiC abrasive paper to prepare a sample to be used.

The texture of (0001) plane in the matrix (Mg phase) of each of the magnesium alloy bar of Example 29 to 33 and Comparative Example 14 was measured by an XRD method (Schultz reflection method). In the measurement, the extruded material was cut at ED-TD cross sections and a cut surface of 6 mm×10 mm was surface-polished with #4000 SiC abrasive paper to prepare a sample to be used.

In the measurement, the tube voltage was 40 kV, and the current value was 40 mA (an X-ray tube used was a Cu tube). The range of the measurement angle α was from 15 to 90°, and the step angle for measurement was 2.5°. The range of the measurement angle β was from 0 to 360°, and the step angle for measurement was 2.5°. Note that background measurement was not conducted. The measured data were normalized by random data (internal standard data), and then with respect to the plate material (alloy plate), a pole figure was drawn with the vertical direction along the RD direction and the horizontal direction along the TD direction. With respect to the bar material (alloy bar), a pole figure was drawn with the vertical direction along the ED direction and the horizontal direction along the TD direction. The measurement was conducted at room temperature (25° C.).

(1) Examples 1 to 5 and Comparative Examples 1, 2, and 3

The measurement results of the texture of (0001) plane by X-ray diffraction are shown in FIG. 1. FIGS. 1(1) to 1(8) show the results of Comparative Examples 1, 2, and 3 and Examples 1 to 5, respectively. The texture intensity (m.r.d.: multiples of random density) indicates the maximum intensity in the pole figure. The contour lines shown in the pole figures in FIG. 1 are relative intensities, and contour lines are drawn with the texture intensity as a maximum value.

Specifically, FIGS. 1(2) to 1(8) show the texture of (0001) planes in the matrix (Mg phase) of a plate material prepared in such a way that a Mg-0.1% Ca alloy is added with 0 to 3% of Cu, then the alloy is rolled from a thickness of 5 mm to 1 mm at a sample temperature of 350° C. followed by annealing.

FIG. 1(1) shows the texture of (0001) plane of pure Mg, and FIG. 1(2) shows the texture of (0001) plane in the matrix (Mg phase) of a Mg-0.1% Ca alloy, and there is observed a texture in which (0001) planes are arranged parallel to a plate surface as a distinct feature in a general-purpose magnesium alloy rolled material. That is, the (0001) plane peaks appear at a position parallel to the ND direction (vertical direction). Compared to pure Mg, the Mg-0.1% Ca alloy added with Ca shows a relatively low texture intensity of (4.1) than that of pure Mg, and it can be confirmed that the orientation of the (0001) plane is randomized to some extent by the addition of Ca.

Next, focusing on the Mg—Cu—Ca-based alloy which is a Mg-0.1% Ca alloy having Cu added, as shown in Examples 1 to 5, the texture intensities decrease with an increase in the concentration of Cu added, and when 0.005% or more of Cu is added, the texture intensities become 3.8 or less, and it can be confirmed that the orientation is randomized. When 0.03% or more of Cu is added, the pole of the (0001) plane appears near at a point tilted by 30° or more away from the ND direction toward the TD or RD direction. As such, the Mg—Cu—Ca-based alloy in which the orientation of the (0001) plane is controlled exhibits a resultant excellent room-temperature formability.

At present, with a central focus on Mg—Zn—Ca-based alloys, there is being promoted an investigation on the mechanism of randomizing the orientation of the texture of (0001) plane in the matrix (Mg phase) after rolling and annealing. For example, Griffiths points out that Zn and Ca dissolved in magnesium segregate in the grain boundary, results in a drag effect which suppresses dynamic recrystallization, and as a result the orientation of (0001) planes is suppressed (D. Griffiths: Mater. Sci. Technol., Vol. 31 (2015), pp. 10-24. ). With respect to the Mg—Cu—Ca-based alloy, it can be considered also that by the same mechanism, Cu and Ca dissolved in magnesium segregate in the grain boundary, results in a drag effect which suppresses dynamic recrystallization, and as a result the orientation of (0001) planes is suppressed.

The precipitates in the magnesium alloy plates of Comparative Examples 2 and 3 and Examples 1 to 5 were identified by X-ray diffraction. In the measurement, the tube voltage was 40 kV, and the current value was 40 mA (an X-ray tube used was a Cu tube). The measurement was conducted with an increment of 0.01°, and the scan speed was 1°/min. The measurement was conducted at room temperature (25° C.).

Figure 2:
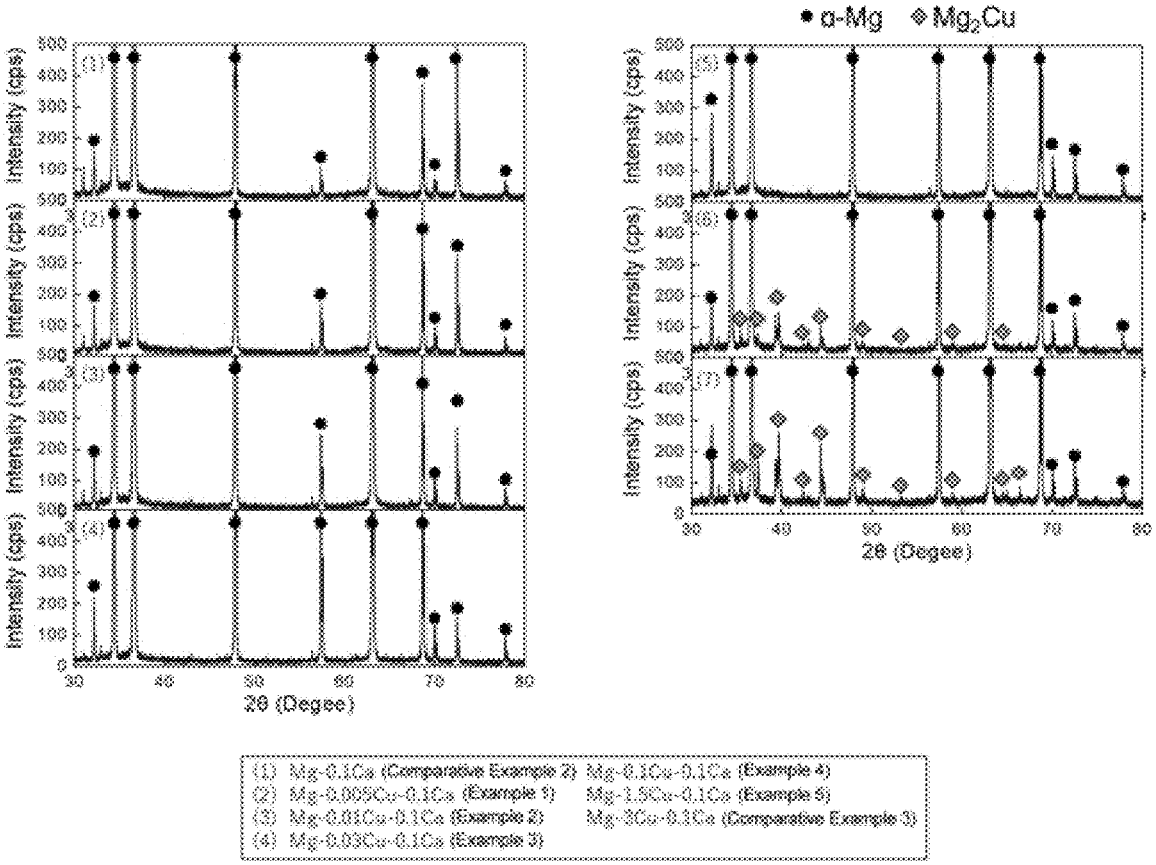
FIG. 2 shows the results of qualitative analysis of the structures of Example 1 to 5 and Comparative Examples 2 and 3 by means of X-ray diffraction.

The identification results of the precipitates by X-ray diffraction are shown in FIG. 2.

FIGS. 2(1) to 2(7) show the results of Comparative Examples 2 and 3 and Examples 1 to 5, respectively. These are the XRD qualitative analysis results of composition of a plate material prepared in such a way that a sample of Mg-0.1% Ca alloy having 0% to 3% of Cu added is rolled from a thickness of 5 mm to 1 mm at a sample temperature of 350° C. and a rolling reduction rate per pass of 20%/pass followed by annealing.

Focusing on FIGS. 2(1) to 2(7), Mg single phase structure is exhibited up to a Cu concentration of 0.1%, but the peaks of $Mg_2Cu$ precipitates appear when the Cu concentration increases to 1.5%. When the Cu concentration is increased to 3%, the peaks thereof are increased, and it is revealed that the precipitates are generated at a relatively large amount. As such, by adding excessive Cu, the relatively large amount of precipitates are generated, and the precipitates become a source of fracture. Therefore, even if the orientation of the (0001) plane is randomized, high level of room-temperature formability cannot be achieved. For example, as shown in Comparative Example 3, the matrix (Mg phase) of a Mg-3% Cu-0.1% Ca alloy has the texture of (0001) plane with a texture intensity of 3.8 or less as shown in FIG. 1(8), but high level of room-temperature formability cannot be achieved due to the presence of the precipitates such as $Mg_2Cu$ as shown in FIG. 2(7).

(2) Examples 3 and 6 to 8 and Comparative Examples 4, 5 and 7

Figure 3:
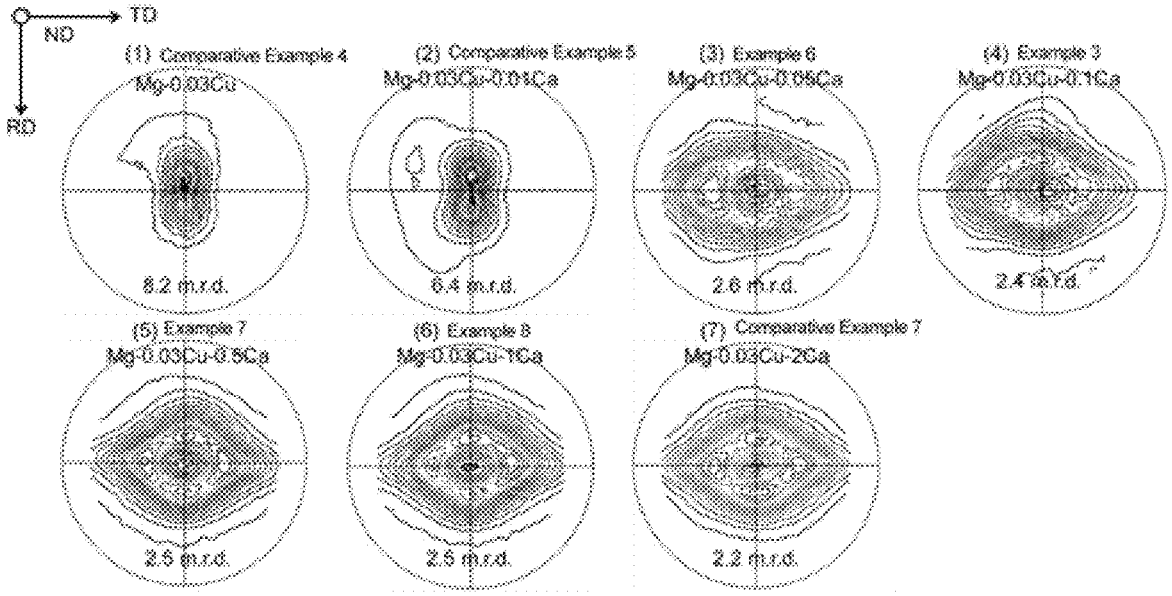
FIG. 3 shows the results of texture analysis of (0001) plane in matrices (Mg phase) of Examples 3 and 6 to 8 and Comparative Examples 4, 5, and 7 by means of X-ray diffraction.

The measurement results of the texture of (0001) plane by X-ray diffraction are shown in FIG. 3. FIGS. 3(1) to 3(7) show the results of Comparative Examples 4, 5, and 7 and Examples 3, 6, 7, and 8, respectively. The measurement conditions are similar to those in FIG. 1 (Comparative Examples 1, 2, and 3 and Examples 1 to 5) described above.

Specifically, FIG. 3(1) shows the texture of (0001) plane in the matrix (Mg phase) of the Mg-0.03% Cu alloy (Comparative Example 3), and FIG. 3(2) shows the texture of (0001) plane of the Mg-0.03% Cu-0.01 Ca alloy (Comparative Example 5), and there is observed the texture in which the (0001) plane arranged parallel to the plate surface as a distinct feature of a general-purpose magnesium alloy rolled material. That is, the (0001) plane peaks appear at a position parallel to the ND direction (vertical direction).

Next, focusing on the Mg—Cu—Ca-based alloy in which 0.05% to 2% of Ca is added to the Mg-0.03% Cu alloy, the texture intensity decreases with an increase in the concentration of Ca added, and when 0.05% or more of Ca is added, the texture intensity becomes 3.8 or less, and it can be confirmed that the orientation is randomized (Examples 3, 6, 7, and 8). When 0.05% or more of Ca is added, the pole of the (0001) plane appears around a point tilted by 30° or more away from the ND direction toward the TD or RD direction. As such, the Mg—Cu—Ca-based alloy in which the orientation of the (0001) plane is controlled exhibits a resultant excellent room-temperature formability.

Figure 4:
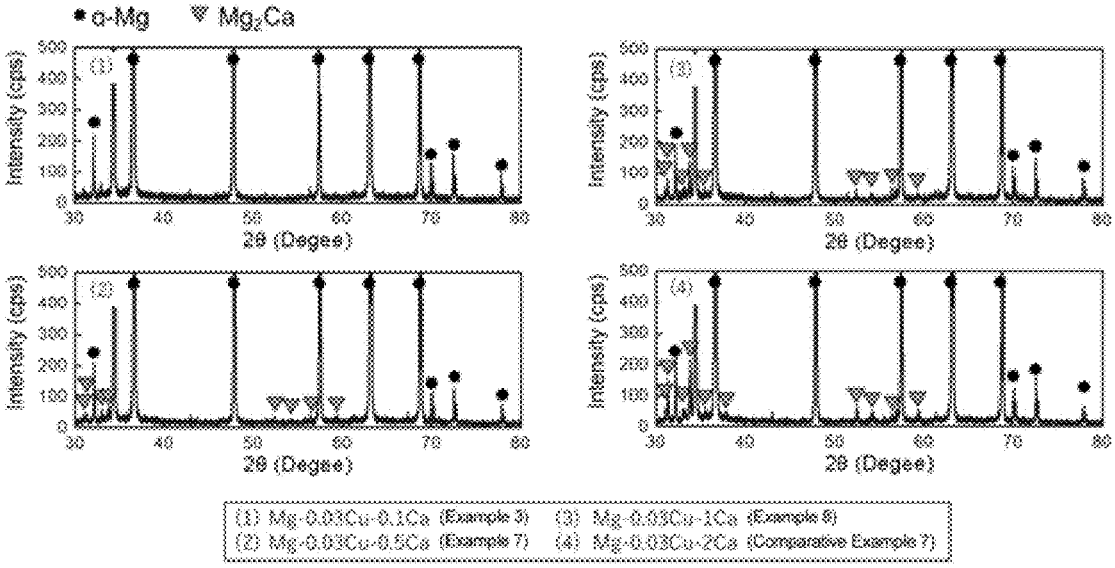
FIG. 4 shows the results of qualitative analysis of the structures of Examples 3, 7, and 8 and Comparative Example 7 by means of X-ray diffraction.

FIG. 4 shows the identification results of the precipitates by X-ray diffraction.

FIGS. 4(1) to 4(4) show the results of Comparative Example 7 and Examples 3, 7, and 8, respectively. These are the XRD qualitative analysis result of composition of a plate material prepared in such a way that a sample of Mg-0.03% Cu alloy having 0.1% to 2% of Ca added is rolled from a thickness of 5 mm to 1 mm at a sample temperature of 350° C. and a rolling reduction rate per pass of 20%/pass followed by annealing. In the measurement, the tube voltage was 40 kV, and the current value was 40 mA (an X-ray tube used was a Cu tube). The measurement was conducted with an increment of 0.01°, and the scan speed was 1°/min.

Focusing on FIGS. 4(1) to 4(4), a Mg single phase structure is exhibited until a Ca concentration of 0.1%, but when the Ca concentration increases to 0.5%, the peaks of $Mg_2Ca$ precipitate appear. It is found that when the Ca concentration increases to 2%, the peaks thereof increase, and a relatively large amount of the precipitates are generated. As described above, by adding excessive Ca, the relatively large amount of precipitate are generated, and the precipitate becomes a source of fracture. Therefore, even if the orientation of the (0001) plane is randomized, high level of room-temperature formability cannot be achieved. For example, the matrix (Mg phase) of a Mg-0.03% Cu-2% Ca alloy (Comparative Example 7) has the (0001) plane texture with a texture intensity of 3.8 or less as shown in FIG. 3(7), but high level of room-temperature formability cannot be achieved due to the presence of the precipitate such as $Mg_2Ca$ as shown in FIG. 4(4).

<3> Other Property Tests (1) Test Methods (The Erichsen Cupping Test)

In order to evaluate the room-temperature formability of the magnesium alloy plates of Example 1 to 28 and Comparative Example 1 to 13, the Erichsen cupping test was performed. The Erichsen cupping test is in accordance with JIS B 7729:1995 and JIS Z 2247:1998. Note that the blank shape had σ60 mm (thickness 1 mm) for the convenience of the plate shape. The mold (sample) temperature was 30° C., the deforming speed was 5 mm/min, and the blank holding force was 10 kN. Graphite grease was used as a lubricant.

(Tensile Test)

In order to evaluate the room-temperature formability of the magnesium alloy bars of Examples 29 to 33 and Comparative Example 14, a tensile test was performed. The tensile test is in accordance with JIS Z 2241:2011. Note that the length of parallel portion of the test piece was 14 mm, and the diameter of the parallel portion was 2.5 mm. The test was conducted at room temperature (20±10° C.), and the initial strain rate was $2.4\times10^{-3}$ $s^{-1}$.

(Saltwater Immersion Test)

In order to evaluate the corrosion rates of the magnesium alloy plates of Examples 1 to 4, 6 to 8, 24, and 26 and Comparative Examples 4 to 8 and 11 to 13, a saltwater immersion test was performed in accordance with JIS H 0541:2003. In this test, a test piece having a thickness of 1.0 mm and a surface area of 13 to 14 mm2 was cut out from the plate material, and the surface of the test piece was wet-polished to #1000 with SiC abrasive paper. The corrosion liquid used was a 5 wt. % NaCl aqueous solution whose pH was adjusted to 9 to 10 by adding $Mg(OH)_2$ powder in advance, and the test piece was immersed in the test solution at 35° C. for 72 hours (Example 26, Comparative Example 8, Comparative Example 11, and Comparative Example 12 were immersed for 6 hours). After the immersion test, the corrosion product was removed with a 10% by mass $CrO_3$ aqueous solution, followed by the mass measurements of the test pieces. Then, the corrosion rate ($mg/cm^2/day$) was calculated from the weight change before and after the test.

(Thermal Conductivity Measurement)

Some of the magnesium alloy plate materials (Examples 3, 5, 9 to 23, 26, and 27 and Comparative Examples 1, 3, 7, 8, 10, 12, and 13) were subjected to thermal conductivity measurement. In the measurement, the thermal conductivity, the specific heat, and the density each were measured at room temperature, and substituted into the above-described Formula (1). In the thermal diffusivity measurement, a sample having a diameter of 10.0 mm and a thickness of 1.5 to 2.5 mm was cut out from the plate material, and the thermal diffusivity was measured by a laser flash method (in vacuo at 25° C.). The specific heat was measured by a DSC method (Ar gas flow of (20 mL/min), temperature raising rate of 10° C./min, measurement temperature of 25° C.). The density was measured by a dimension measurement method (23° C.). Note that the stated measurement of the thermal conductivity is in accordance with JIS R 1611:2010.

(Electrical Conductivity Measurement)

The electrical conductivities of the magnesium alloy plates and the magnesium alloy bars of Examples 1 to 33 and Comparative Examples 1 to 14 were measured. In the measurement of the plate, the surface of the sample was polished with #4000 SiC abrasive paper, and then a four-terminal (probe) method was used to determine the electrical conductivities at room temperature (25° C.). In the measurement of the bar, the extruded material was cut at ED-TD cross sections to prepare a sample, which was used after surface polishing with #4000 SiC abrasive paper. Note that the measuring method of the electrical conductivity is in accordance with JIS K 7194:1994.

(Investigation on Presence or Absence of Aging Precipitation Hardening)

Some of the magnesium alloy plates (Examples 12 and 15 to 17) were checked for the presence or absence of the aging precipitation hardening. In this investigation, the plate material was held in an electric furnace maintained at a predetermined temperature (170° C.) for 8 hours, and then the Vickers hardness thereof was evaluated. The Vickers hardness test is in accordance with JIS Z 2244. The test load was 0.2 kgf, the holding time was 10 seconds, by removing the maximum value and the minimum value from the obtained test values of 10 points, the remaining data of 8 points was averaged and the average was taken as the Vickers hardness.

(2) Results

The results are summarized in Tables 2 and 3.

TABLE 2

| | Alloy | Erichsen value at room temperature (mm) | Texture intensity of (0Texture intensity of (0001) plane (m.r.d.) | Thermal conductivity (W/(m.K)) | Electrical conductivity (S/m) | Presence or absence of coarse precipitates | Presence or absence of aging hardening | Corrosion rate (mg/cm2/day) |
|---|---|---|---|---|---|---|---|---|
| Example 1 | Mg-0.005Cu-0.1Ca | 6.5 | 3.1 | — | $1.8 \times 10^7$ | Absent | — | 1.51 |
| Example 2 | Mg-0.01Cu-0.1Ca | 7.3 | 2.7 | — | $1.8 \times 10^7$ | Absent | — | 1.36 |
| Example 3 | Mg-0.03Cu-0.1Ca | 7.7 | 2.4 | 157 | $1.8 \times 10^7$ | Absent | — | 1.47 |
| Example 4 | Mg-0.1Cu-0.1Ca | 7.6 | 2.7 | — | $1.9 \times 10^7$ | Absent | — | 2.36 |
| Example 5 | Mg-1.5Cu-0.1Ca | 7.2 | 2.4 | 158 | $1.7 \times 10^7$ | Absent | — | |
| Example 6 | Mg-0.03Cu-0.05Ca | 7.7 | 2.6 | — | $1.9 \times 10^7$ | Absent | — | 1.41 |
| Example 7 | Mg-0.03Cu-0.5Ca | 7.2 | 2.5 | — | $1.9 \times 10^7$ | Absent | — | 0.96 |
| Example 8 | Mg-0.03Cu-1Ca | 6.6 | 2.5 | — | $1.5 \times 10^7$ | Absent | — | 1.45 |
| Example 9 | Mg-0.02Cu-0.05Ca | 8 | 2.9 | 158 | $1.8 \times 10^7$ | Absent | — | |
| Example 10 | Mg-0.03Cu-0.1Ca-0.1Al | 8.2 | 2.4 | 150 | $1.5 \times 10^7$ | Absent | — | |
| Example 11 | Mg-0.03Cu-0.1Ca-0.1Mn | 7.6 | 2.6 | 148 | $1.6 \times 10^7$ | Absent | — | |
| Example 12 | Mg-0.03Cu-0.1Ca-0.1Al-0.1Mn | 7.6 | 2.3 | 153 | $1.5 \times 10^7$ | Absent | Present | |
| Example 13 | Mg-0.03Cu-0.1Ca-0.3Al | 7 | 2.7 | 145 | $1.5 \times 10^7$ | Absent | — | |
| Example 14 | Mg-0.03Cu-0.1Ca-0.3Mn | 8 | 2.7 | 146 | $1.7 \times 10^7$ | Absent | — | |
| Example 15 | Mg-0.03Cu-0.5Ca-0.5Al-0.3Mn | 7.4 | 2.2 | 131 | $1.4 \times 10^7$ | Absent | Present | |
| Example 16 | Mg-0.1Cu-0.5Ca-0.5Al-0.3Mn | 6.9 | 2.3 | 128 | $1.4 \times 10^7$ | Absent | Present | |
| Example 17 | Mg-0.3Cu-0.5Ca-0.5Al-0.3Mn | 7.2 | 2.4 | 129 | $1.4 \times 10^7$ | Absent | Present | |
| Example 18 | Mg-0.03Cu-0.1Ca-0.1Zn | 8.3 | 2.6 | 150 | $1.6 \times 10^7$ | Absent | — | |
| Example 19 | Mg-0.03Cu-0.1Ca-0.1Zr | 8 | 2.3 | 151 | $1.6 \times 10^7$ | Absent | — | |
| Example 20 | Mg-0.03Cu-0.1Ca-0.1Zn-0.1Zr | 8.6 | 2.4 | 152 | $1.5 \times 10^7$ | Absent | — | |
| Example 21 | Mg-0.03Cu-0.1Ca-0.3Zn | 8.4 | 2.8 | 151 | $1.7 \times 10^7$ | Absent | — | |
| Example 22 | Mg-0.03Cu-0.1Ca-0.3Zr | 8 | 2.6 | 142 | $1.4 \times 10^7$ | Absent | — | |
| Example 23 | Mg-0.03Cu-0.1Ca-0.3Zn-0.3Zr | 8.3 | 2.3 | 150 | $1.4 \times 10^7$ | Absent | — | |
| Example 24 | Mg-0.01Ni-0.1Ca | 6.6 | 2.8 | — | $1.8 \times 10^7$ | Absent | — | 3.28 |
| Example 25 | Mg-0.0238Ni-0.1Ca | 7.5 | 2.3 | — | $1.5 \times 10^7$ | Absent | — | |
| Example 26 | Mg-0.1Ni-0.1Ca | 8.5 | 2.9 | 154 | $1.8 \times 10^7$ | Absent | — | 73.00 |
| Example 27 | Mg-0.5Ni-0.1Ca | 7.2 | 2.9 | 151 | $1.7 \times 10^7$ | Absent | — | |
| Example 28 | Mg-0.1Ni-0.05Ca | 6.8 | 3.8 | — | $1.6 \times 10^7$ | Absent | — | |
| Comparative Example 1 | Mg | 3 | 16.3 | 167 | $2.0 \times 10^7$ | Absent | — | |
| Comparative Example 2 | Mg-0.1Ca | 4.3 | 4.1 | — | $1.9 \times 10^7$ | Absent | — | |
| Comparative Example 3 | Mg-3Cu-0.1Ca | 6.4 | 2.7 | 156 | $1.6 \times 10^7$ | Present | — | |
| Comparative Example 4 | Mg-0.03Cu | 3.3 | 8.2 | — | $2.0 \times 10^7$ | Absent | — | 6.00 |
| Comparative Example 5 | Mg-0.03Cu-0.01Ca | 3.6 | 6.4 | — | $2.0 \times 10^7$ | Absent | — | 3.71 |
| Comparative Example 6 | Mg-0.03Cu-0.03Ca | 6.4 | 3.1 | — | $1.8 \times 10^7$ | Absent | — | 1.81 |
| Comparative Example 7 | Mg-0.03Cu-2Ca | 6.2 | 2.2 | 147 | $1.4 \times 10^7$ | Present | — | 3.51 |
| Comparative Example 8 | Mg-0.1Ni | 3.3 | 9.4 | 167 | $1.7 \times 10^7$ | Absent | — | 66.00 |
| Comparative Example 9 | Mg-1.5Ni-0.1Ca | 3.4 | 7.7 | — | $1.6 \times 10^7$ | Present | — | |
| Comparative Example 10 | Mg-3Ni-0.1Ca | 3.4 | 6.3 | 149 | $1.6 \times 10^7$ | Present | — | |
| Comparative Example 11 | Mg-0.1Ni-0.01Ca | 3.3 | 9.3 | — | $1.8 \times 10^7$ | Absent | — | 65.00 |
| Comparative Example 12 | Mg-0.1Ni-2Ca | 3.7 | 3.5 | 147 | $1.4 \times 10^7$ | Present | — | 64.00 |
| Comparative Example 13 | AZ31 (Mg-3Al-1Zn in wt. %) | 2.2 | 8.3 | 86.8 | $1.13 \times 10^7$ | Absent | — | 2.40 |

55

TABLE 3

| | Alloy | Yield stress (MPa) | Tensile strength (MPa) | Percentage elongation after fracture (%) | Texture intensity of (0001) plane (m.r.d.) | Electrical conductivity (S/m) |
|---|---|---|---|---|---|---|
| Example 29 | Mg-0.03Cu-0.05Ca | 194 | 243 | 20 | 6.8 | $1.9 \times 10^7$ |
| Example 30 | Mg-0.03Cu-0.1Ca | 217 | 253 | 24 | 4.0 | $1.8 \times 10^7$ |
| Example 31 | Mg-0.1Cu-0.1Ca | 219 | 251 | 17 | 5.5 | $1.9 \times 10^7$ |
| Example 32 | Mg-1.5Cu-0.1Ca | 236 | 166 | 17 | 4.0 | $1.7 \times 10^7$ |

TABLE 3-continued

| | Alloy | Yield stress (MPa) | Tensile strength (MPa) | Percentage elongation after fracture (%) | Texture intensity of (0001) plane (m.r.d.) | Electrical conductivity (S/m) |
|---|---|---|---|---|---|---|
| Example 33 | Mg-0.1Ni-0.1Ca | 238 | 261 | 16 | 5.8 | $1.8 \times 10^7$ |
| Comparative Example 14 | Mg-0.03Cu-2Ca | 294 | 308 | 10 | 4.8 | $1.4 \times 10^7$ |

(2-1) Mg—Cu—Ca-Based Alloy Plate

Table 2 shows that Comparative Example 1, Comparative Example 2, Comparative Example 4, and Comparative Example 5, to which a predetermined amount of Cu or Ca was not added, exhibit the texture intensity of (0001) plane of a value higher than 3.8 in the matrix (Mg phase) thereof, and as a result, it was confirmed that they exhibited the Erichsen values at room temperature of less than 6.5.

In contrast, Examples 1 to 23, to which predetermined concentrations of Cu and Ca (Cu: 0.005 to 1.5% by mass, Ca: 0.05 to 1.0% by mass) and Al, Zn, Mn, and Zr (Al: 0 to 0.5% by mass, Zn, Mn, Zr: 0 to 0.3% by mass) were added, the texture intensities of (0001) plane exhibit a value of 3.8 or less in the matrices (Mg phase) thereof, and as a result, it was confirmed that they exhibited the Erichsen values at room temperature of 6.5 or more. Furthermore, with respect to Example 3, Example 4, Example 6, Example 9, Examples 10 to 12, Example 14, and Examples 18 to 23, it was confirmed that they exhibit the Erichsen values at room temperature of 7.5 or more, and that they exhibit the room-temperature stretch formability comparable to that of the aluminum alloy.

Comparison of Examples 3, 5, and 9 to 23 with Comparative Examples 1 and 13 shows that, as in Examples 3, 5, and 9 to 23, by addition of Cu and Ca at predetermined concentrations, and further addition of Al, Zn, Mn, and Zr, thermal conductivities higher than 120 (W/(m·K)) are exhibited, and thermal conductivities (120 to 170 (W/(m·K))) at room temperature (25° C.) comparable to that of the aluminum alloy for structure are exhibited.

Furthermore, the magnesium alloy plates of Example 1 to 23 exhibited a high electrical resistivity of $1.3\times10^7$ (S/m) or more. As described above, the thermal conductivity and the electrical conductivity are in a proportional relationship at the same temperature, and it can be said that the Mg—Cu—Ca-based alloy having an electrical conductivity higher than $1.3\times10^7$ (S/m) has a thermal conductivity comparable to that of the aluminum alloy for structure.

As described above, FIG. 1, FIG. 3, and Table 2 indicate that in the magnesium alloy plate in which the Cu content is 0.005 to 1.5% by mass, the Ca content is 0.05 to 1.0% by mass, the Al content is 0 to 0.5% by mass, and the contents of Zn, Mn, and Zr are 0 to 0.3% by mass, the texture intensity of (0001) plane in the matrix (Mg phase) is 3.8 or less. Moreover, FIGS. 2 and 4, and Table 2 show that by addition of Cu and/or Ca exceeding the above-described range, as shown in Comparative Example 3 and Comparative Example 7, the generation of precipitates such as $Mg_2Cu$ and $Mg_2Ca$, which could be a source of fracture during deformation, increases, and coarse precipitates are generated.

Focusing on corrosion properties, the magnesium alloy plates of Examples 1 to 4 and Examples 6 to 8 exhibited a corrosion rate of 3.0 or less, and particularly, those of Examples 1 to 3 and 6 to 8 exhibited corrosion resistance superior to that of the AZ31 alloy (Comparative Example 13). As described above, it can be said that the Mg—Cu—Ca-based alloy also has excellent corrosion resistance required as a structural member.

In addition, focusing on the evaluation results of the aging precipitation hardening properties performed for Examples 12 and 15 to 17, an increase in the Vickers hardness can be confirmed when the alloy composition is chosen to be a predetermined concentration, and it is found that the aging precipitation hardening can enhance the hardness and the yield stress of the material.

(2-2) Mg—Ni—Ca-Based Alloy Plate

Table 2 shows that the texture intensity of (0001) plane exhibits a value higher than 3.8 in the matrix (Mg phase) of Comparative Example 1, Comparative Example 2, and Comparative Examples 8 to 11, to which a predetermined amount of Ni or Ca was not added, and as a result, it was confirmed that they exhibited the Erichsen value at room temperature of less than 6.5.

In contrast, with respect to Examples 24 to 28 to which predetermined concentrations of Ni and Ca (Ni: 0.01 to 0.5% by mass, Ca: 0.05 to 1.0% by mass) were added, the texture intensities of (0001) plane in the matrix (Mg phase) thereof exhibit a value of 3.8 or less, and as a result, it was confirmed that they exhibited the Erichsen values at room temperature of 6.5 or more. Furthermore, with respect to Example 25 and Example 26, the Erichsen value at room temperature was 7.5 or more, and it was confirmed that they exhibited the room temperature stretch formability comparable to that of the aluminum alloy.

With respect to Examples 26 and 27, it is found that by adding Ni and Ca at predetermined concentrations, they exhibited a thermal conductivity higher than 120 (W/(m·K)), and it can be seen that they exhibit a thermal conductivity (120 to 170 (W/(m·K))) at room temperature (25° C.) comparable to that of the aluminum alloy for structure.

Furthermore, the magnesium alloy plates of Example 24 to 28 exhibited a high electrical resistivity of $1.3\times10^7$ (S/m) or more. As described above, the thermal conductivity and the electrical conductivity are in a proportional relationship at the same temperature, and it can be said that the Mg—Ni—Ca-based alloy having an electrical conductivity higher than $1.3\times10^7$ (S/m) has a thermal conductivity comparable with that of the aluminum alloy for load-bearing applications.

As described above, with respect to the magnesium alloy plate in which the Ni content is 0.01 to 0.5% by mass, the Ca content is 0.05 to 1.0% by mass, the Al content is 0 to 0.5% by mass, and the contents of Zn, Mn, and Zr each are 0 to 0.3% by mass, it is found that the texture intensity of (0001) plane in the matrix (Mg phase) is 3.8 or less. It can be seen that, based on Comparative Example 9, Comparative Example 10, and Comparative Example 12, the addition of Ni and/or Ca exceeding the above-described range increases the amount of precipitates such as $Mg_2Ni$ and $Mg_2Ca$, which could be a source of fracture during deformation, and as a result high formability cannot be achieved.

Focusing on the corrosion properties, while the magnesium alloy plate material of Example 26 exhibited a high corrosion rate, the magnesium alloy plate material in Example 24 exhibited a corrosion resistance comparable to that of the AZ31 alloy (Comparative Example 13). As such, it can be said that by optimizing the composition of the alloy, the Mg—Ni—Ca-based alloy can also have corrosion resistance required for a structural member as in the case of the Mg—Cu—Ca-based alloy.

(2-3) Mg—Cu—Ca-Based Alloy Bar and Mg—Ni—Ca-Based Alloy Bar

Table 3 shows that the texture intensity of (0001) plane is a value of 6.8 or less in each of the matrices (Mg phase) of Examples 29 to 33 to which predetermined concentrations of Cu and Ca (Cu: 0.005 to 1.5% by mass, Ca: 0.05 to 1.0% by mass) or predetermined concentrations of Ni and Ca (Ni: 0.01 to 0.5% by mass, Ca: 0.05 to 1.0% by mass) were added, and as a result, it was confirmed that they exhibited the percentage elongation after fracture of 15% or more. Furthermore, it was confirmed that Example 29 and Example 30 exhibited a percentage elongation after fracture of 20% or more and exhibited formability comparable to that of the aluminum alloy.

The magnesium alloy bar of Examples 29 to 33 exhibited a high electrical resistivity of $1.3\times10^7$ (S/m) or more. As described above, the thermal conductivity and the electrical conductivity are in a proportional relationship at the same temperature, and it can be said that the Mg—Cu—Ca-based alloy and the Mg—Ni—Ca-based alloy, which have electrical conductivity higher than $1.3\times10^7$ (S/m), have thermal conductivity comparable with that of the aluminum alloy for structure.

As described above, with respect to the magnesium alloy bar (Mg—Cu—Ca-based alloy bar) in which the Cu content is 0.005 to 1.5% by mass, the Ca content is 0.05 to 1.0% by mass, the Al content is 0 to 0.5% by mass, and the contents of Zn, Mn, and Zr each are 0 to 0.3% by mass, the texture intensity of (0001) plane in the matrix (Mg phase) is 6.8 or less, and it can be seen that high formability and thermal conductivity are concurrently achieved.

In addition, with respect to the magnesium alloy bar (Mg—Ni—Ca-based alloy bar) in which the Ni content is 0.01 to 0.5% by mass, the Ca content is 0.05 to 1.0% by mass, the Al content is 0 to 0.5% by mass, and the contents of Zn, Mn, and Zr each are 0 to 0.3% by mass, the texture intensity of (0001) plane in the matrix (Mg phase) is 6.8 or less, and it can be seen that high formability and thermal conductivity are concurrently achieved.

INDUSTRIAL APPLICABILITY

The magnesium alloy plate and the magnesium alloy bar of the present invention have an intention of improving the room-temperature workability or formability of Mg—Cu—Ca-based alloys and Mg—Ni—Ca-based alloys having an excellent thermal conductivity. Moreover, the magnesium alloys of the present invention have corrosion resistance required for structural applications, and some of the magnesium alloys are improved in their hardness, and hence the problem of the conventional magnesium alloys having room-temperature formability, that is, the problem of their poor heat dissipation properties is solved. As a result, the magnesium alloys of the present invention are a material, on which a more complicated processing at room temperature can be made, from which components having excellent heat dissipation properties can be made, and which can contribute to weight reduction and enhanced functionality of electronic devices and automobile components.

The invention claimed is:

1. A magnesium alloy plate comprising a magnesium alloy, wherein a texture intensity of (0001) plane of hexagonal close-packed crystal is 3.8 or less in a matrix (Mg phase) of the magnesium alloy plate, wherein an electrical conductivity of the magnesium alloy plate is $1.3\times10^7$ S/m at room temperature of 10 to 35° C., and wherein the magnesium alloy, comprises:

Cu in a content of 0 to 1.5% by mass;

Ni in a content of 0.0238 to 0.5% by mass;

Ca in a content of 0.05 to 1.0% by mass;

Al in a content of 0 to 0.5% by mass;

Zn in a content of 0 to 0.3% by mass;

Mn in a content of 0 to 0.3% by mass; and

Zr in a content of 0 to 0.3% by mass, wherein a total amount of the Cu and the Ni is 0.0238 to 2.0% by mass, and a balance is magnesium and unavoidable impurities.

2. A magnesium alloy bar comprising a magnesium alloy, wherein a texture intensity of (0001) plane of hexagonal close-packed crystal is 6.8 or less in a matrix (Mg phase) of the magnesium alloy bar, wherein an electrical conductivity of the magnesium alloy bar is $1.3\times10^7$ S/m at room temperature of 10 to 35° C., and wherein the magnesium alloy, comprises:

Cu in a content of 0 to 1.5% by mass;

Ni in a content of 0.0238 to 0.5% by mass;

Ca in a content of 0.05 to 1.0% by mass;

Al in a content of 0 to 0.5% by mass;

Zn in a content of 0 to 0.3% by mass;

Mn in a content of 0 to 0.3% by mass; and

Zr in a content of 0 to 0.3% by mass, wherein a total amount of the Cu and the Ni is 0.0238 to 2.0% by mass, and a balance is magnesium and unavoidable impurities.

3. The magnesium alloy plate according to claim 1, wherein the content of the Cu is 0.005 to 1.5% by mass in the magnesium alloy.

4. The magnesium alloy plate according to claim 1, wherein in the magnesium alloy, the content of the Cu is 0.03 to 0.3% by mass, the content of the Ca is 0.1 to 0.5% by mass, and the content of the Al is 0.1 to 0.5% by mass.

5. The magnesium alloy plate according to claim 1, wherein a corrosion rate as measured by a saltwater immersion test according to JIS H 0541 (2003) is 4 mg/cm2/day or less.

6. The magnesium alloy bar according to claim 2, wherein the content of the Cu is 0.005 to 1.5% by mass in the magnesium alloy.

7. The magnesium alloy bar according to claim 2, wherein in the magnesium alloy, the content of the Cu is 0.03 to 0.3% by mass, the content of the Ca is 0.1 to 0.5% by mass, and the content of the Al is 0.1 to 0.5% by mass.

8. The magnesium alloy bar according to claim 2, wherein a corrosion rate as measured by a saltwater immersion test according to JIS H 0541 (2003) is 4 mg/cm2/day or less.

* * * * *